United States Patent [19]

Boucher

[11] Patent Number: 4,893,570

[45] Date of Patent: Jan. 16, 1990

[54] COMBUSTION FURNACE

[76] Inventor: Robert J. Boucher, P.O. Box 985, Bonner, Mont. 59823

[21] Appl. No.: 276,883

[22] Filed: Nov. 28, 1988

Related U.S. Application Data

[60] Division of Ser. No. 32,972, Apr. 2, 1987, Pat. No. 4,829,914, which is a continuation of Ser. No. 672,132, Nov. 16, 1984, abandoned.

[51] Int. Cl.[4] ..... F23J 15/00

[52] U.S. Cl. ..... 110/203; 110/214

[58] Field of Search ..... 237/55; 122/20 B; 126/77; 110/203, 214, 234

[56] References Cited

U.S. PATENT DOCUMENTS 4,372,487 2/1983 Hollister ..... 122/20 B X 4,561,421 12/1985 Hwang et al. ..... 237/55 X

*Primary Examiner*—Henry A. Bennet

*Attorney, Agent, or Firm*—James P. Hamley

[57] ABSTRACT

A solid fuel combustion chamber combusts the fuel utilizing underfire and overfire air. Both the underfire and overfire air derive from a common intake port, with a controllable vane determining the ratio between the two air sources. Gas flow from the solid fuel combustion chamber enters a gas combustion chamber designed to produce turbulence and thereby promote further combustion. The gas flow is then accelerated in a gas flow chamber and directed to the circulating fluid carrying tubes of a heat exchanger. The heat exchanger includes a condensation chamber which extracts sufficient heat from the gas flow to produce a condensate. An injection system superheats the condensate and injects it into the solid fuel combustion chamber to thereby reduce residue accumulation.

15 Claims, 5 Drawing Sheets

Fig. 1
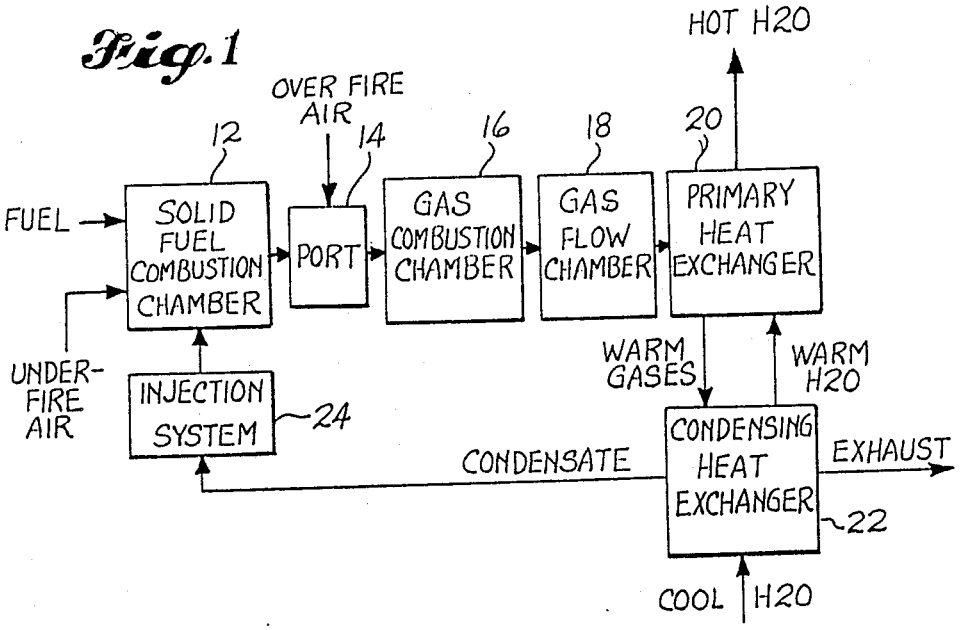
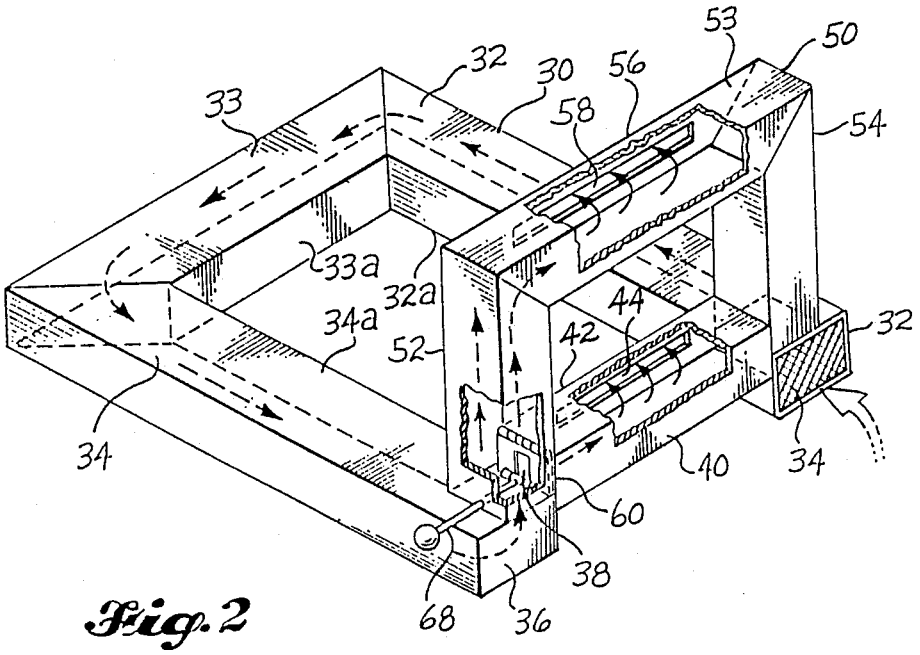
Fig. 2

Fig. 8
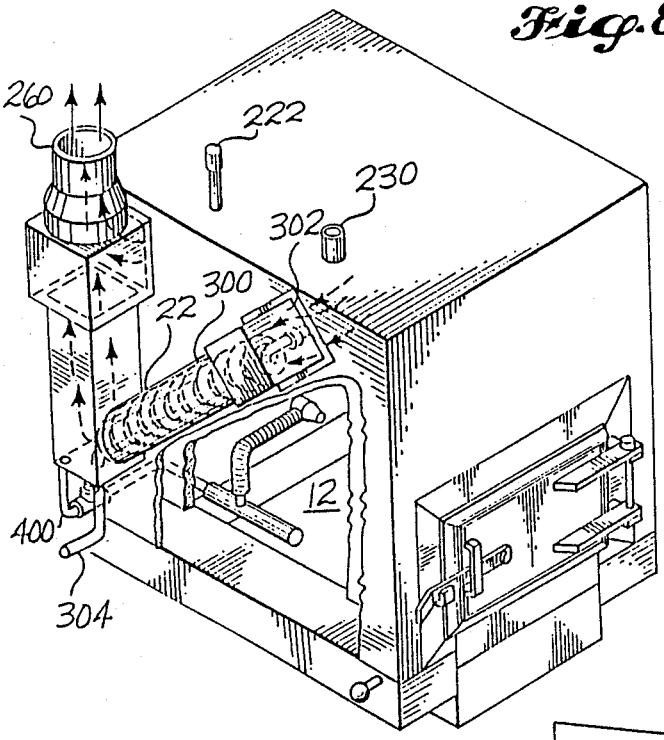
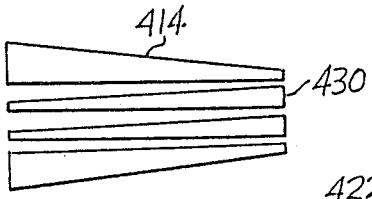
Fig. 10A
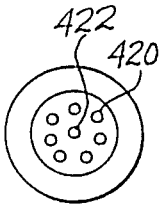
Fig. 10B
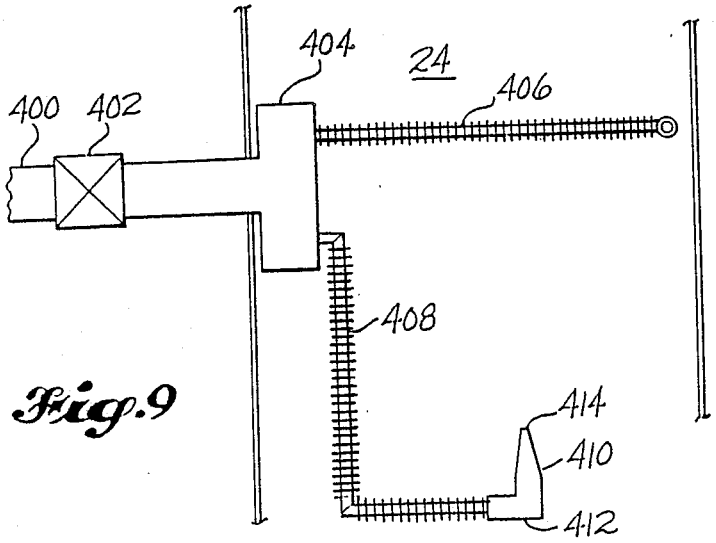
Fig. 9

COMBUSTION FURNACE

This application is a division of Ser. No. 032,972, now U.S. Pat. No. 4,829,914, filed Apr. 2, 1987 which is a continuation of Ser. No. 672,132 filed Nov. 16, 1984, now abandoned.

BACKGROUND OF THE INVENTION

The present invention is directed to the combustion furnace art and, more particularly, to a high efficiency, low pollution solid fuel furnace.

Whereas numerous solid fuel combustion furnaces are known to the prior art, none of these designs incorporates state-of-the-art technology. As a result, such furnaces are relatively inefficient, and often produce high pollution levels. The high cost of electricity and oil has produced a renewed interest in solid fuel furnaces, particularly wood burning furnaces. The pollution levels produced by wood burning furnaces are, however, a major concern, as is the relative inefficiency of conventional wood burning furnace designs.

There is a long felt need in the solid fuel furnace art, therefore, for a highly efficient, low pollution producing solid fuel furnace.

SUMMARY OF THE INVENTION

The present invention, therefore, is directed to a combustion furnace which is particularly suited for the combustion of solid fuels, including wood and coal. The present design employs advanced biomass gasification theory in the combustion process and a novel arrangement of combustion chambers, heat exchangers, a condensing chamber and a condensate injection system to achieve high efficiency with low pollution levels.

Briefly, according to the invention, a combustion furnace comprises a combustion chamber for combusting fuel with intake air, an air intake port, and an air intake ducting means for routing the intake air introduced through the air intake port to both an underfire position below the level of the fuel in the combustion chamber and an overfire position above the level of the fuel in the combustion chamber. A controllable vane regulates the proportion of the intake air which is routed through the intake ducting to the underfire and overfire positions.

In one aspect of the invention, the air intake ducting includes a first tube section having a predetermined inner area and being conformed in position to define the perimeter of the combustion chamber, with the air intake for the combustion furnace positioned at an open end of the first tube. A second tube has an air intake port positioned proximate to an air vent which is provided at the end of the first tube distal from the air intake port. An output port is provided in the second tube in a position to direct the underfire air within the combustion chamber. A third tube has an air intake port positioned proximate to the first tube air vent and has an output port elevated from the second tube outlet port to direct the overfire air within the combustion chamber.

A position control plate is positioned at the first tube air vent, intermediate the second and third tube air intake ports. The ratio of underfire to overfire air is controlled by positioning of this plate.

In a further aspect of the invention, the combustion chamber is comprised of a six-sided enclosure having a trapezoidal cross section with the forward wall being shorter than the rear wall and with the top section sloping upwardly from front to rear. The top section is provided with a gas exhaust port proximate the rear wall. The overfire air is routed over the upper surface of the top wall to the exhaust port such that the gas flow produced by combustion of the fuel for the underfire air is mixed with the overfire air at the exhaust port.

A gas combustion chamber combusts the gas flow produced by combustion of the fuel in the combustion chamber. The gas combustion chamber is, preferably, formed as a six-sided enclosure having an inverted, generally trapezoidal cross section with a rear wall being shorter than the forward wall and the bottom section sloping upwardly from front to rear. The bottom section is parallel to, and predeterminedly elevated from the top section of the combustion section to thereby define the flow path for the overfire air. The gas combustion chamber bottom section is divided with the gas intake port positioned proximate to the exhaust port of the combustion chamber for receiving the gas flow. The top section of the gas combustion chamber is provided with an exhaust port proximate the forward wall of the gas combustion chamber.

A six-sided gas flow chamber is positioned adjacent to, and elevated from the gas combustion chamber. The gas flow chamber is rectangular in cross section and has a bottom section provided with an intake port adjacent the exhaust port of the gas combustion chamber for receiving the gas flow. The gas flow chamber top section has a provided exhaust port for venting the gas flow at the end of the gas flow chamber distal from the intake port. The gas flow chamber is configured to reduce turbulance in, and increase the velocity of the gas flow.

A heat exchanger is positioned adjacent to, and elevated from the gas flow chamber. The heat exchanger includes an intake port adjacent the exhaust port of the gas flow chamber for introducing gas flow into the heat exchanger, a heat exchanging system for extracting the heat from the gas flow and an exhaust port for venting the gas flow.

A condensation chamber receives the gas flow from the heat exchanger exhaust port and includes heat extraction means for further cooling the gas flow to produce a condensate.

An injector superheats the condensate and injects the superheated condensate into the combustion chamber for the combustion thereof. The injector is preferably comprised of a manifold having an inlet for receiving the condensate from the condensation chamber and a pair of outlets. A first tube connects at one end to one of the manifold outlets and is closed at its remaining end. The first tube is positioned in a high temperature region of the combustion chamber. A second tube connects one end to the other one of the manifold outlets and is open at its remaining end. A nozzle end connects to the open end of the second tube, with the nozzle having an expansion chamber and predetermined apertures for directing the condensate to a predetermined portion of the combustion chamber.

BRIEF DESCRIPTION OF THE DRAWINGS

FIG. 1 is a block diagram illustrating the principal components of the preferred combustion furnace construction;

FIG. 2 is a perspective view illustrating the preferred construction of the overfire/underfire air ducting and the control vane;

FIG. 8 is a perspective, partial cutaway view illustrating the condensing chamber and heating system as seen from the side of the combustion furnace;

FIG. 9 is a schematic view illustrating the preferred condensate injection system; and FIGS. 10A and 10B illustrate side and front face views, respectively, of the nozzle head for use in the preferred condensate injection system.

DETAILED DESCRIPTION

Figure 3:
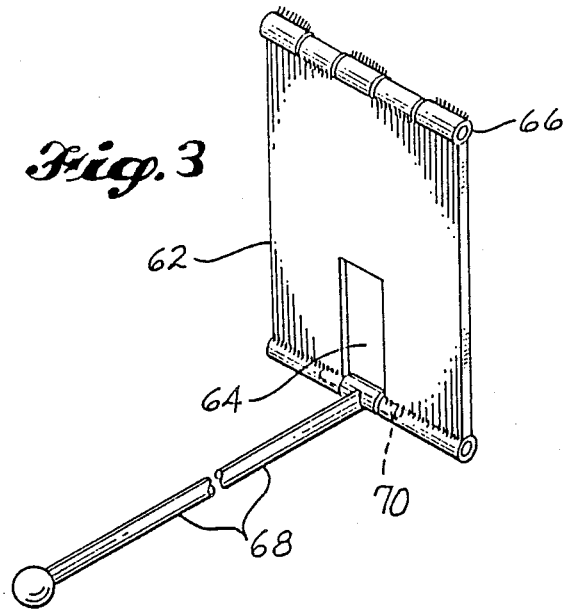
FIG. 3 is a detailed perspective drawing illustrating construction of the controllable vane illustrated in FIG. 2.

FIG. 1 is a block diagram of the principal combustion furnace components, and provides a conceptional overview of system operation.

Fuel, preferably a solid fuel such as cord wood, is loaded into the solid fuel combustion chamber 12. Also introduced into the solid fuel combustion chamber 12 is underfire air, which is approximately 10% stoichiometric. The combustion of the solid fuel with the underfire air produces two chemical reactions. First, volatiles (producer gas) are driven off and char is produced. The volatiles pass out of the solid fuel combustion chamber as a gas flow. The char reacts with carbon dioxide, steam and air to produce carbon monoxide and hydrocarbons which also pass as part of the gas flow out of the solid fuel combustion chamber 12. The ratio of volatiles to char produced is dependent upon four variables: (1) temperature, (2) percent of underfire air, (3) solid fuel size and (4) moisture content of the solid fuel. Thus, volatiles and more char are produced with lower temperature, less underfire air, larger pieces of solid fuel and higher moisture content of the solid fuel. The disclosed combustion furnace produces extremely high combustion efficiencies regardless of the type of fuel used or its moisture content. For example, green and wet wood combust as efficiently as dry wood in the disclosed furnace. The only difference is that wet and green wood combust at a slower rate than dry wood.

As the solid fuel is gasified, the gases exit the solid fuel combustion chamber 12 and pass through a port 14 at which point very hot overfire air is introduced for gas flow combustion. The gases and overfire air combine at this port 14 and enter a gas combustion chamber 16. The gas combustion chamber 16 is designed to produce turbulence in the gas flow, whereby combustion of the gas flow is enhanced.

The combined products then enter a gas flow chamber 18 which provides additional time for combustion and also causes the combustion products to increase in velocity, with reduced turbulence, so that the gas flow leaves the gas flow chamber with momentum. This aids in the draft of the combustion furnace.

The accelerated gas flow from the gas flow chamber 18 is directed to a primary heat exchanger 20. The primary heat exchanger 20 extracts 75–80% of the sensible heat from the combustion products. Provided within the primary heat exchanger 20 are tubes carrying a fluid, such as water, which may be used to space heat a dwelling or provide potable hot water. The gas flow from the primary heat exchanger 20, now cooled due to the heat exchanger heat transfer process, enter a condensing heat exchanger chamber 22. The condensing heat exchanger extracts 10–15% of the sensible heat and 90% of the latent heat from the gas flow. The combustion products are ultimately cooled to 38 degrees C–52 degrees C (100 degrees F–125 degrees F). At this reduced temperature, approximately 90% of the condensable products in the gas flow are condensed to a liquid state condensate.

The remaining gas is vented through a flue exhaust.

In the preferred embodiment of the invention, the heat exchanger fluid, preferably water, enters the condensing chamber at ambient temperature, is warmed through the action of the condensing chamber and is further heated through the action of the primary heat exchanger 20.

The condensate produced in the condensing chamber 22 is gravity fed into an injection system 24. The injection system 24 injects the condensate into the hot char bed within the solid fuel combustion chamber 12 under very high temperature and pressure. This process allows for the combustion and elimination of the condensate and at the same time aids in the combustion process of the solid fuel.

FIG. 2 is a perspective drawing illustrating the preferred construction of the air ducting system used to provide both underfire and overfire air. Testing has determined that the most efficient combustion of solid wood requires 10–20% of the air to enter as underfire air on the wood and 80–90% of the air to enter as overfire air to combust the gases. This underfire/overfire technique results in much higher temperatures in the char bed than can be obtained with the traditional wood combustion systems.

The air intake ducting system of FIG. 2 includes a first tube 30 which is generally C shaped having leg sections 32, 34 and a common section 33. In this, the preferred embodiment of the invention, the first tube 30 is formed of 10.2 centimeter×15.2 centimeter (4 inch×6 inch) metal ducting. The leg sections 32, 34 are 86.4 centimeters (34 inches) long whereas the common section 33 is 71 centimeters (28 inches) long.

The free end of the second leg section 34 is closed off by a blanking plate 36. Provided in the top surface of the end of the second leg 34 is an exhaust port 38. Proximate to the exhaust port 38 is the open end of a second tube 40 which spans the ends of the first tube legs 32, 34. Provided in the rear vertical face 42 of the second tube 40 is an elongated slot 44. In this, the preferred embodiment of the invention, the slot 44 is 3.8 centimeters×30.5 centimeters (1½ inch×12 inch) and provides the entrance port into the solid fuel combustion chamber of the underfire air. The second tube 40 is, preferably, formed of 10.2×10.2 centimeter (4 inch×4 inch) metal tube.

Also spanning the leg sections 32, 34 of the first tube 30, and having an opening proximate the exhaust port 38 is a third tube 50. The third tube 50 has vertically standing leg sections 52, 54 and a horizontal cross piece 53.

Provided in the rear, vertical face 56 of the cross piece section 53 is an elongated slot 58 which provides overfire air to the combustion furnace. In this, the preferred embodiment of the invention, the sections 52–54 of the third tube 50 are formed of 10.2 centimeter × 10.2 centimeter (4 inch × 4 inch) metal tubing. The slot 58 is 3.8 centimeter × 35.6 centimeters (1½ inches × 14 inches).

A position controlled vane assembly 60 is positioned at the intersection of exhaust port 38 and the entrance to the second and third tubes 40, 50. More specifically, the controllable vane comprises a plate 62, shown more clearly with respect to FIG. 3 which is generally rectangular in shape. The plate 62 mounts on a hinge mechanism 66 such that it may be positioned in front of the entrance to second tube 40 or, in its alternate position in a blocking position to cover the entrance to third tube 50. A control rod 68 connects to the bottom of plate 62 via a hinge mechanism 70. The control rod, which is accessible through the exterior surface of the combustion furnace, is manually setable to control the proportion of air which is routed through second tube 40 as underfire air or to third tube 50 as overfire air.

Suitable stops (not shown) are provided in the vane assembly 60 and the slot 64 in plate 62 is dimensioned such that a minimum sustaining flow of underfire and overfire air is provided, regardless of the setting of the plate 62.

In position in the furnace, the ducting assembly of FIG. 2 is positioned at the base of the solid combustion chamber such that the forward vertical faces **32*a*, 33*a* and 34*a* define the outer perimeter of the combustion chamber area. Fuel is fed into the furnace through an access door (see FIG. 7). Fresh air enters the furnace through fresh air port 34 passing around the C-shaped sections of the first tube 30. During the course of its journey around the first tube 30, the air is preheated to 260 degrees C–316 degrees C (500 degrees F–600 degrees F). The air then reaches the exhaust port 38 and, as determined by the position of the vane assembly 60, is proportionately routed to the second and third tubes 40, 50. Assuming that the vane assembly 60 is positioned with plate 62 at a 45 degree angle, the air is divided equally for both over and underfire air. The underfire air enters the solid fuel combustion chamber through the slot 44**.

The overfire air rises through the legs 52, 54 of the third tube 50 and exits the overfire air slot 58 at a temperature of 760 degrees C–871 degrees C (1400 degree F–1600 degree F), where, as is described more thoroughly herein below, the preheated air combusts the gas flow from the solid fuel combustion chamber.

Figure 4:
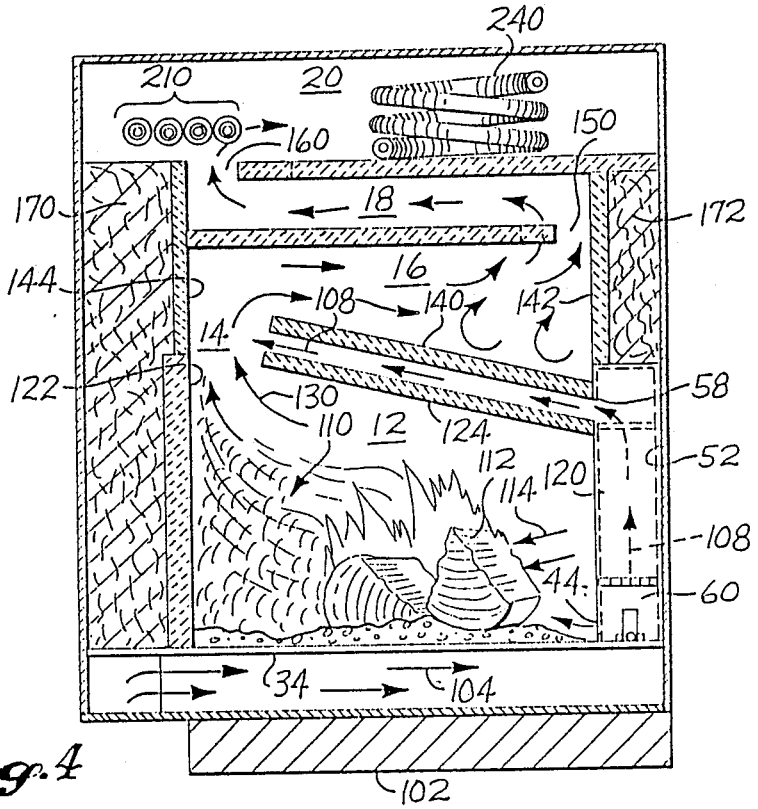
FIG. 4 is a cross sectional view of the combustion furnace illustrating combustion of the solid fuel and subsequent hot gas flow.

FIG. 4 is a cross sectional view, taken from the side, of the combustion furnace illustrating the solid fuel chamber 12, the gas combustion chamber 16, port 14 which joins gas combustion chamber 16 with solid fuel combustion chamber 12, the gas flow chamber 18 and the bottom portion of the primary heat exchanger 20.

At the base of the furnace is a layer of insulation 102 formed of vermiculite and air-intrained concrete (insulating concrete).

Shown above the base insulation layer 102 is the second leg section 34 of the first tube in the air ducting system shown with respect to FIG. 2. Indicated are arrows, such as arrow 104, illustrating the flow of fresh air as it is preheated in its journey about the first tube. Depending upon the position of the movable vane assembly 60, a portion of the preheated fresh air flow 104 is diverted as underfire air, indicated by dotted arrows 106, with the remainder being diverted in the overfire path, as indicated by arrow 108.

The underfire air 106 circulates about insulating concrete (not shown) which supports the solid fuel, here comprised of a char bed 110 and newly entered logs, such as log 112. Fuel is loaded into the stove in a direction indicated by arrows, such as arrow 114, from the right to the left through an access door (not shown). In this way, the char is built up toward the back of the combustion chamber as shown in the figure. Testing has shown that a much higher combustion efficiency is obtained when the volatiles from the fresh wood 112 pass through or over the very hot char coal. The solid fuel combustion chamber 12 is a six-sided enclosure, having a trapezoidal cross section. The forward wall 120 of the solid fuel combustion chamber 12 is shorter than the rear wall 122, such that the top section 124 slopes in an upwardly direction from front to rear. The sloping top section 124 of solid fuel combustion chamber 12 enhances the tendency for the char 110 to be pushed to the back, and pile up when the combustion chamber 12 is charged. After several loadings, the char 110 will pile higher in the back whereby the fuel, particularly the newly entered fuel 112 in the front half of the combustion chamber 12 will combust at a faster rate due to its proximity to the air intake ports and the injector (discussed herein below) whereby volatiles and moisture from the newly entered logs 112 will pass through and over the char, aiding the combustion process.

In this, the preferred embodiment of the invention, the various sections of the solid fuel combustion chamber 12, including the rear wall 122 and top section 124, are formed of a fused silica.

The producer gas flow, illustrated by arrow 130, from the solid fuel combustion chamber 12 flows up to port 14 at the junction of the solid fuel combustion chamber 12 and the gas combustion chamber 16. Overfire air, as represented by arrow 108 is routed over the top section 124 of the solid fuel combustion chamber 12 to mix with the gas flow 130 at port 14. The flow of the overfire air 108 is controlled from above by the lower section 140 of the gas combustion chamber 16. Gas combustion chamber 16 is a six-sided enclosure, which is trapezoidal in cross section with its forward wall 142 being longer than its rear wall 144. As such, the bottom section 140 of the gas combustion chamber 16 slopes upwardly from front to rear, running parallel to, and elevated a predetermined distance from the top of the top section 124 of the solid fuel combustion chamber 12.

The producer gas 130 mixes with the preheated overfire air, which is at approximately 760 degrees C–871 degrees C (1400 degree F–1600 degree) and enters the gas combustion chamber. Due to its inverted trapezoidal shape, the gas combustion chamber 16 acts as an expansion chamber causing the gases to tumble to provide very good air-gas mixing and also to slow down the flow of the gas to provide sufficient time for full combustion. As the gases flow into the expansion chamber 16, their velocity is reduced and the gases tend to settle. As high velocity gases hit the lower settling gases a turbulence is created. Testing has shown that the gas combustion chamber averages approximately 93 degrees C (200 degrees F) higher temperatures than the exit area of the solid fuel combustion chamber 12. This indicates that the shape of gas combustion chamber 16 is effective in fully combusting the gas.

In this, the preferred embodiment of the invention, the walls of the gas combustion chamber, including front wall 142, rear wall 144, bottom section 140, and a top section 148 are made from a vacuum-formed ceramic.

The gas flow from the gas combustion chamber 16 then exits through an exhaust port 150 to the gas flow chamber 18.

Figure 5:
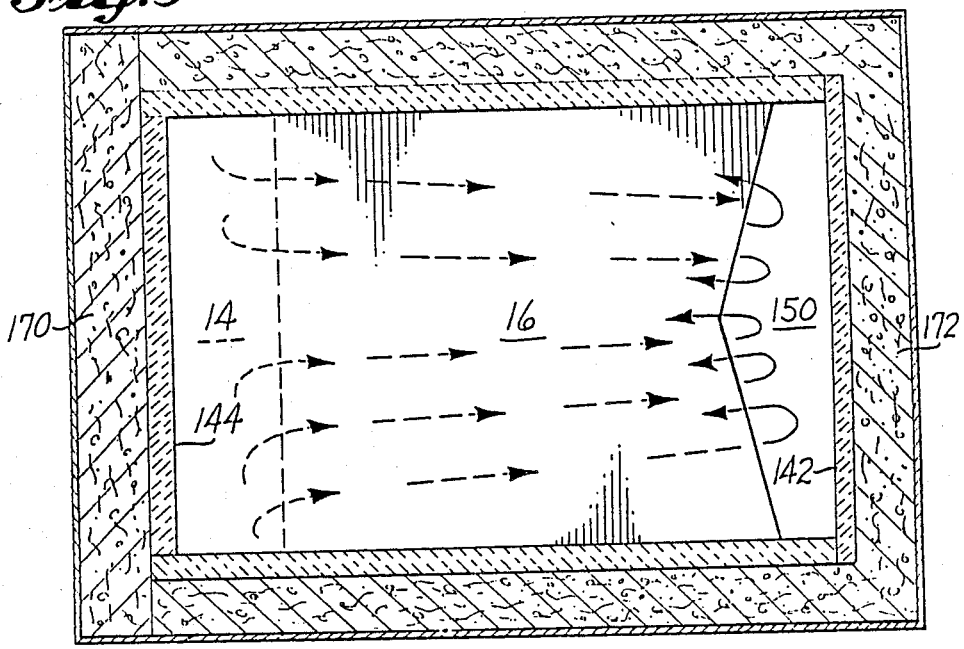
FIG. 5 is a cross sectional view, taken from above, illustrating the configuration of the exhaust ports from the solid fuel combustion chamber and the gas combustion chamber.

FIG. 5 is a top view illustrating the flow of gases from the entrance to the gas expansion chamber at port 14 through the gas combustion chamber 16 and to the gas combustion chamber exit port 150. The shape of the exit port 150 is critical. Port 150, with its triangular edge centered in the gas combustion chamber 16 and facing the middle thereof, causes the gas flow (indicated by arrows) to concentrate towards the center of the exhaust port 150. This helps to reduce the turbulence in the gas flow and also prepares the gases from exiting into the primary heat exchanger 20.

Returning to FIG. 4, the gas flow chamber 18 is a six-sided figure, being generally rectangular in cross section. The gas flow chamber 18 is designed to reduce turbulence in the gas flow and accelerate the gas flow to a high momentum.

The gases exit the gas flow chamber 18 through an exhaust port 160.

Figure 6:
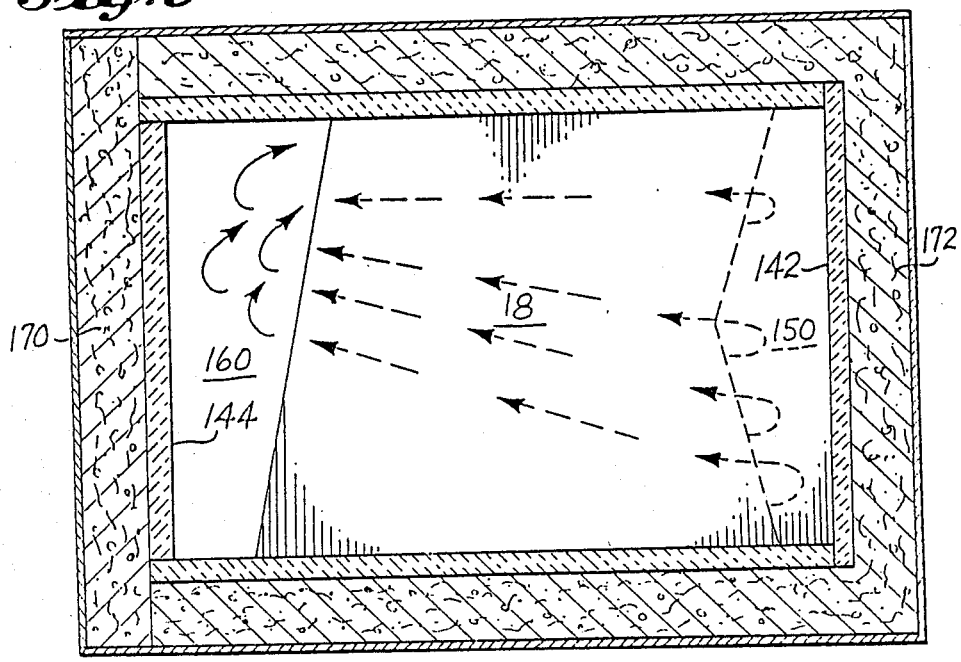
FIG. 6 is a cross sectional view, taken from above, illustrating the configuration of the exhaust port from the gas flow chamber.

FIG. 6 is a cross sectional view taken from above, illustrating the gas flow through the gas flow chamber 18 as it enters via port 150 and exits through port 160. Exhaust port 160 is, as shown, trapezoidal in shape having an angled forward edge which tends to route the gas flow, as indicated by arrows, to one side of exhaust port 160. This, as will be better understood with respect to FIG. 7, causes the gas flow to impinge on the heat exchanger in a manner to produce optimum heat transfer efficiency.

As with the gas combustion chamber 16, the various walls of the gas flow chamber 18 are preferably comprised of a vacuum-formed ceramic. Also, it will be noted that insulation sections 170, 172 are provided about the combustion furnace to prevent heat losses.

Figure 7:
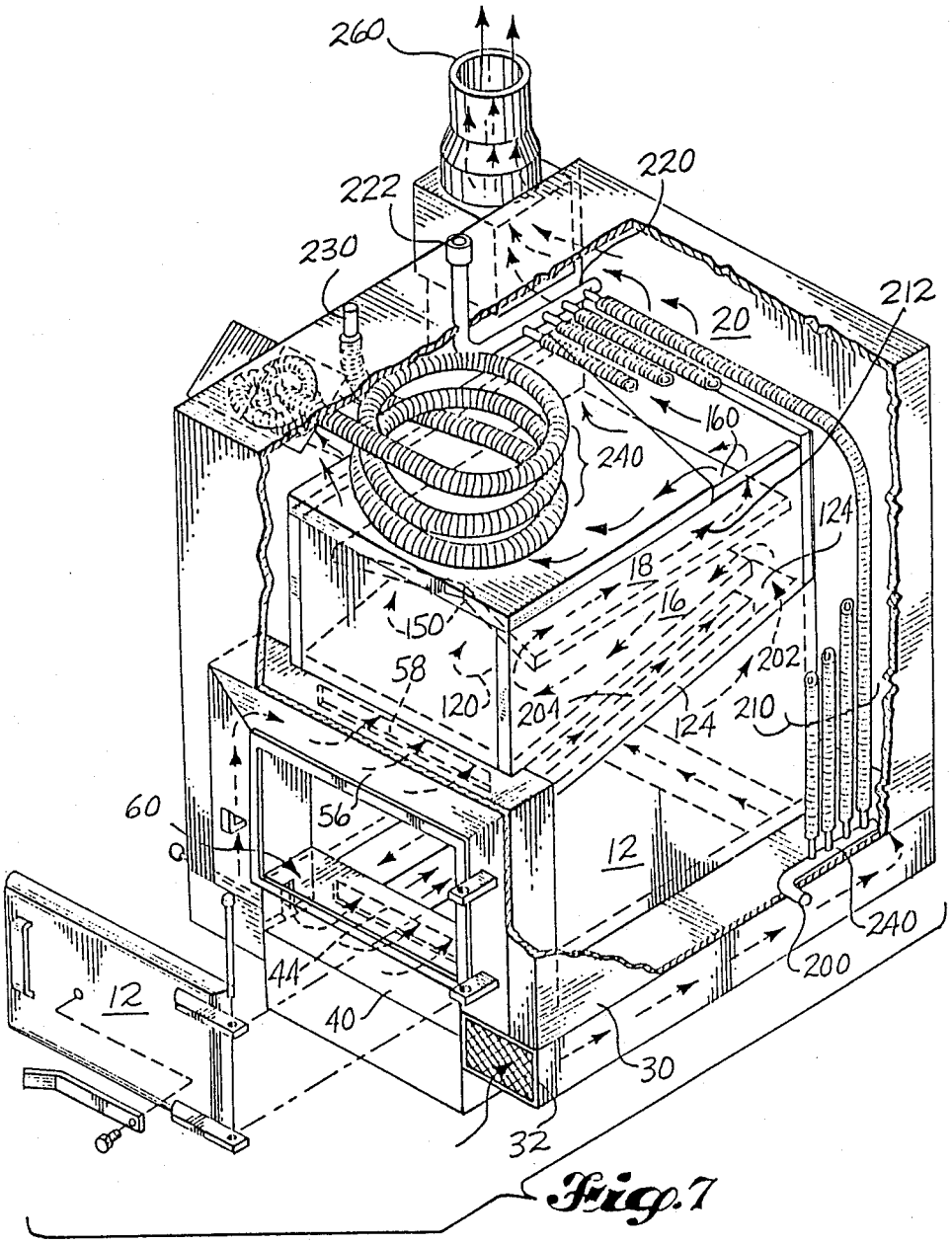
FIG. 7 is a perspective, partially cutaway view of the combustion furnace as seen from the front.

The hot gases that exit from the exhaust port 160 of the gas flow chamber 18 then enter the heat exchanger portion 20, which is shown more clearly with respect to FIG. 7.

FIG. 7 is a perspective, partially cutaway view of the entire combustion furnace. Air intake to the furnace is provided through the air intake 32 which is at the open end of the C-shaped first tube 30. The air circulates around the first tube 30 and is preheated by a combustion process in the solid fuel combustion chamber 12. The preheated air in first tube 30 is then divided, as determined by the position of the controllable vane assembly 60 into underfire air, which is routed through a second tube 40 and vented through an exit exhaust port 44, and overfire air which is carried through a third tube 50, also C-shaped, with the overfire air being exited through an exhaust port 58. The burning solid fuel within the solid fuel combustion chamber 12 produces a gas flow which, as indicated by arrows 202, travels underneath the top section 124 of the solid fuel combustion chamber 12 to a port 124 where it is mixed with the overfire air, as indicated by arrow 204 which is routed between the top section 124 of the solid fuel combustion chamber 12 and the bottom section 140 of the gas combustion chamber 16. The gas flow then tumbles down through the gas combustion chamber 16 as indicated by arrow 210 to enhance gas combustion. The gas then flows up through a port 150 to the gas flow chamber 18. Flow through chamber 18 is indicated by arrow 212. The gas flow from gas flow chamber 18 exits through the exit port 160 to enter the heat exchanger 20.

In this, the preferred embodiment of the invention, the combustion furnace is designed to heat both domestic potable water as well as water used for purposes of providing space heating.

Potable domestic water is fed into the furnace via an input pipe 200. Pipe 200 enters within the furnace shell 202, which is formed of sheet metal, and joins a manifold assembly 204. Attached to the manifold 204 are a plurality of water carrying pipes 214. The water carrying pipes are routed vertically upward around the solid fuel combustion chamber 12, the gas combustion chamber 16, and the gas flow chamber 18 and then angle around into the heat exchanger 20 and over the exhaust port 160. The domestic potable water pipes terminate at a manifold 220 which joins to the domestic potable water output line 222 which projects vertically from the top of the combustion furnace.

Also projecting vertically from the top of the furnace is the output line 230 from the space heating water line. The space heating water runs through a coil 240 which is positioned in the heat exchanger 20 forward of the potable lines 210 and the exhaust port 160. The circulating water in the space heating water coil 240 is routed out the left side of the furnace to a condensing chamber which is better shown with respect to FIG. 8.

Shown projecting from the back left portion of the combustion furnace is a flue stack 260 which, also, is better shown with respect to FIG. 8.

Due to the high momentum, and laminer flow of the gases as they enter the heat exchanger 20, and due to the channeling of the exhaust port 160, the gas flow strikes the fluid carrying tubes 160 of the potable water supply and the coil 240 of the space heating water system making a 45 degree turn to exit out a port in the furnace left side, and enter the condensing chamber shown in FIG. 8. The primary heat exchanger 20 is designed to extract approximately 80% of the sensible heat in the gas flow.

It should be understood that a suitable insulation is provided within shell 202 to minimize heat loss.

FIG. 8 is a partial cutaway, perspective view taken from the left side of the combustion furnace.

Shown is the condensing chamber, indicated generally at 22, which is comprised of an outer tubular cylindrical shell 300 which contains a coiled finned tube 302. Coiled tube 302 contains the space heating, circulating water, which is fed into the coil 302 from the space heating input pipe 304.

In the preferred embodiment of the invention, the condensing chamber shell 300 is a stainless steel tube which is 10.16 centimeters (4 inches) in diameter and the circulating water carrying tube 302 is 1.27 centimeter (0.5 inches) in diameter and finned.

In the center of the finned tube 302 coil is a twisted stainless steel vane (not shown), commonly known as a turbulator. This turbulator causes the combustion gases to impinge on the coil 302 to enhance heat exchange efficiency.

The condensing chamber 22 is inclined at approximately a 45 degree angle with respect to vertical as it extends from the heat exchanger portion 20 of the furnace back to the solid fuel combustion chamber 12. The approximately 45 degree angle was found to be an optimum angle to promote flow efficiency and heat exchanger efficiency. As the gases in the condensing chamber 22 cool, moisture is condensed on the finned tube 302 and the gas further condenses as rain in the center of the finned tube coil 302. As the droplets are formed on the finned tube 302 they accumulate to form larger droplets which fall from the top side of the finned coiled tube 302 to the lower side. In the course of this dripping, the droplets pass through the gas flow area, thereby aiding in cooling the combustion gases which, in turn, cool and produce more condensate.

Also, by providing the 45 degree angle, the downward gas flow aids the draft because as the gases get cooler they also get heavier and have a natural tendency to fall. If the condensing chamber 22 were vertical, the condensing aid of the droplets would be lost because they would rain vertically down the tube without falling through the path of the oncoming gas flow. If, however, the condensing chamber 22 were horizontal, draft through the furnace is impeded due to the production of increasingly heavier gases which do not accelerate under the force of gravity.

At the base of condensing chamber 22, therefore, are two products. First, a dry gas flow, and second, a condensate. The dried gas flow is passed to a flue 260 which rises vertically up along side the combustion furnace. Conduction from the combustion furnace to the flue, and the flue to the gases, increases the gas temperature thereby promoting gas flow out of the flue and aiding in the draft and the furnace. It should be pointed out that all chambers within the combustion furnace, as well as all ports are designed to have a cross sectional area at least 1.5 times the cross sectional area of the flue 260. This promotes the flow of gas throughout the furnace and avoids the need for a damper bypass past the gaseous combustion chambers during furnace start-up.

The condensate which collects at the bottom of the condensing chamber 22 is an undesirable residue to the system. Rather than simply draining off the condensate, which could constitute a health hazard, the present invention includes an injection system to inject the condensate back into the furnace and combust it.

The condensate must be heated above the critical temperature (374 degrees C (706 degrees F) for water) to assure that it is superheated such that no condensing occurs when the condensate steam is subjected to high pressure.

Referring to FIGS. 8 and 9, the condensate from the base of the condensing chamber 22 is routed via a pipe 400, through a one way check valve 402 and to a manifold 404 which is positioned within the solid fuel combustion chamber 12. The manifold 404 is provided with two outlets. Attached to the first outlet is a first tube 406 which crosses the solid fuel combustion chamber 16 passing through the hottest coals, and extending upwardly at a 90 degree angle. This tube is blanked off at its distal end.

A second tube 408 connects to the second outlet from the manifold 404 and is routed up the back wall of the furnace and then through a 90 degree bend outwards to a position where its free end points to the char within the solid fuel combustion chamber. A nozzle 410 attaches to the end of the second tube 408.

In this, the preferred embodiment of the invention, the line 400 is 1.9 centimeter (¾ inch) in diameter and the first and second tubes 406, 408 are 0.95 centimeter (⅜ inch) in diameter formed of stainless steel and finned.

The second tube 408 has a total volume of 90 cubic centimeters (5.5 cubic inches). An expansion chamber 412 provided in the nozzle 410 has a volume 20–25% of the volume tube 408. An injector 414 is provided at the end of nozzle 410.

FIGS. 10A and 10B are side, and face views, respectively, of the injector. The injector has 6 holes, one being shown at 420, which are arranged in a circle about a center hole 422.

Each of the six holes 420 in the center hole 422 forms the end of one of multiple bores provided through the nozzle 414. The bore feeding the center hole 422 has a volume of 268 cubic centimeters (0.1243 cubic inches), whereas each of the remaining peripheral six bores has a volume of 0.9 cubic centimeters (0.055 cubic inches). Each of the six bores is between 0.08 and 0.238 centimeters (3/32 to 1/32 inches) in diameter and 11.43 centimeters (4½ inches) long. The center bore is 0.32 centimeters to 0.16 centimeters (⅛ inch to 1/16 inch) in diameter and is also 11.43 centimeters (4½ inches) long.

Operation of the injection system is understood as follows. The check valve 402 opens causing a charge of condensate to be gravity fed into the manifold 404 and into the tubes 406, 408. The condensate is then heated, increasing pressure and forcing the check valve to seat. The tubes heat to approximately 870 degrees C to 980 degrees C (1600 degrees F–1800 degrees F). The blanked tube 406 builds pressure and forces additional liquid from the manifold into the second tube 408. The steam generated from the condensate travels to the expansion chamber 412 in the nozzle head 410. Here the steam expands but does not drop in temperature. Expansion chamber 412 is very hot from conduction and radiation from the char in the solid fuel combustion chamber. The steam then enters the nozzle 414 and is compressed, thereby further increasing in temperature. The steam is then ejected from the nozzle 414 at a very high velocity into the char bed. The nozzle 414 is a heat sink and absorbs heat during the low pressure portion of the injection cycle, transferring this heat to the steam during the high pressure cycle period.

The injection system, indicated generally at 24, also seems to work as an air injection system by allowing air to flow in with the condensate and combining the air with the steam and injecting the air under pressure.

While the specific mechanism for consuming the condensate is not fully understood, the following is offered only as one possible theory. It appears that the water is disassociated into hydrogen and oxygen. The oxygen combines with carbon in the char producing carbon monoxide and hydrocarbons. Recent research has shown that the reaction of cellulose with carbon monoxide and steam at 382 degrees C (720 degrees F) and 1500 pounds per square inch produces oil. The organics are then combusted. The hydrogen combines with oxygen and carbon in the solid fuel and gas combustion chamber to form water and $CH_4$ (methane). Approximately 10% of the moisture is not condensed and exits the flue into the atmosphere, thereby accounting for the hydrogen.

In summary, an improved combustion furnace has been described in detail. The furnace exhibits a high efficiency while producing minimal pollutants.

Whereas the preferred embodiment of the invention has been described in detail, it should be apparent that many modifications and variation thereto are possible, all of which fall within the true spirit and scope of the invention.

I claim:

1. A solid fuel combustion furnace comprising:

a solid fuel combustion chamber formed as a six-sided enclosure having a trapezoidal cross section with the forward wall being shorter than the rear wall and the top section sloping upwardly from front to rear, said top section being provided with a gas exhaust port proximate said rear wall; and a gas combustion chamber for combusting the gas flow produced by combustion of the solid fuel in the solid fuel combustion chamber, the gas combustion chamber formed as a six-sided enclosure having an inverted, generally trapezoidal cross section with the rear wall being shorter than the forward wall and the bottom section sloping upwardly from front to rear, said bottom section being parallel to the top section of said solid fuel combustion chamber, said gas combustion chamber bottom section being provided with a gas intake port proximate to the exhaust port of said combustion chamber for receiving said gas flow, the top section of said gas combustion chamber being provided with an exhaust port proximate the forward wall of said gas combustion chamber for venting said gas flow, whereby the expanding shape of the gas combustion chamber produces gas flow turbulence to thereby promote combustion.

2. The solid fuel combustion furnace of claim 1 wherein:

said solid fuel combustion chamber forward wall is provided with a fuel load port for introducing solid fuel into the solid fuel combustion chamber such that the char bed builds up toward the back of the solid fuel combustion chamber, whereby combustion of the newly loaded fuel is promoted by flow of the gases from the combustion of said newly loaded fuel over said char bed.

3. The solid fuel combustion furnace of claim 1 further comprising:

a six-sided gas flow chamber adjacent to, and elevated from said gas combustion chamber, said gas flow chamber being formed rectangular in cross section and having a bottom section provided with an intake port adjacent the exhaust port of said gas combustion chamber for receiving said gas flow and a top section having a provided exhaust port for venting said gas flow at the end of said gas flow chamber distal from said intake port, said gas flow chamber reducing the turbulence in, and increasing the velocity of said gas flow.

4. The solid fuel combustion furnace of claim 3 wherein:

said gas flow chamber intake port is predeterminedly configured to concentrate gas flow to the center of said gas flow chamber to thereby reduce gas flow turbulence.

5. The solid fuel combustion furnace of claim 4 further comprising:

a heat exchanger adjacent to, and elevated from said gas flow chamber, said heat exchanger including:

an intake port adjacent the exhaust port of said gas flow chamber for introducing the gas flow to said heat exchanger;

heat exchanging means for extracting the heat generated from said gas flow; and exhaust port means for venting said gas flow.

6. The solid fuel combustion furnace of claim 5 wherein:

said heat exchanger intake port is predeterminedly configured to route the gas flow to said heat exchanging means for maximum heat transfer efficiency.

7. The solid fuel combustion furnace of claim 6 further comprising:

a condensation chamber receiving the gas flow from said gas flow chamber and including heat extraction means for further cooling said gas flow to produce a condensate.

8. The solid fuel combustion furnace of claim 7 further comprising:

injector means for superheating said condensate and injecting said superheated condensate into said combustion chamber.

9. The solid fuel combustion furnace of claim 8 wherein said injector means further comprises:

a manifold having an inlet for receiving the condensate from said condensation chamber and a pair of outlets;

a first tube connected at one end to one of said manifold outlets and being closed at its remaining end, said first tube being positioned in a high temperature region of said combustion chamber;

a second tube connected at one end to the other one of said manifold outlets and being open at its remaining end; and a nozzle connected to the open end of said second tube, said nozzle having an expansion chamber and predetermined apertures for directing said condensate to a predetermined portion of said solid fuel combustion chamber.

10. The solid fuel combustion furnace of claim 9 wherein said injector means further comprises:

a one-way valve for preventing condensate flow from the injector means back into said condensation chamber.

11. A combustion furnace comprising:

a combustion chamber for combusting a fuel to produce a high temperature gas flow;

heat exchanger means positioned adjacent to, and above said combustion chamber, for transferring the heat from said gas flow to a circulating fluid, said heat exchanger means including a condensing chamber comprised of a duct extending from said heat exchanger means down to said combustion chamber with the gas flow from said heat exchanger means being vented to said duct, said duct including said circulating fluid such that the remaining heat in said gas flow is transferred to said circulating fluid and said gas flow is sufficiently cooled to produce a condensate at the base of said duct;

a flue extending from the base of said condensing chamber vertically for venting the gas flow from said condensing chamber; and a condensate injection system for injecting said condensate into said combustion chamber for the combustion thereof.

12. The combustion furnace of claim 11 wherein:

said condensing chamber comprises a cylindrical tube having a coiled tube extending longitudinally therein, said coiled tube containing said circulating fluid, said cylindrical tube extending from said heat exchanger means to said combustion chamber inclined at a predetermined angle with respect to vertical, said predetermined angle being sufficiently vertical to assure proper drafting of the furnace and sufficiently horizontal to cause condensation droplets on said coiled tube to fall from high to low coil positions through the gas flow to thereby promote heat transfer.

13. The combustion furnace of claim 12 wherein said cylindrical tube is inclined at an angle of approximately 45 degrees with respect to vertical.

14. The combustion furnace of claim 11 wherein said condensate injection system comprises:

a manifold having an inlet for receiving said condensate and a pair of outlets;

a first tube connected at one end to one of said manifold outlets and being closed at its remaining end, said first tube positioned in a high temperature region of said combustion chamber;

a second tube connected at one end to the other one of said manifold outlets and being open at its remaining end; and a nozzle connected to the open end of said second tube, said nozzle having an expansion chamber and predetermined apertures for directing said condensate to a predetermined portion of said combustion chamber.

15. The combustion furnace of claim 14 wherein said condensate injection system further comprises:

a one-way valve for preventing condensate flow from the injection system back into said condensing chamber.

* * * * *